US007971550B2

(12) United States Patent
Hansen et al.

(10) Patent No.: US 7,971,550 B2
(45) Date of Patent: Jul. 5, 2011

(54) RIGID TUBE BUOYANCY ASSEMBLY FOR BOATS

(76) Inventors: John F. Hansen, Tumwater, WA (US); Lloyd T. Hansen, University Place, WA (US)

( * ) Notice: Subject to any disclaimer, the term of this patent is extended or adjusted under 35 U.S.C. 154(b) by 232 days.

(21) Appl. No.: 12/130,342

(22) Filed: May 30, 2008

(65) Prior Publication Data

US 2009/0293789 A1 Dec. 3, 2009

(51) Int. Cl.
*B63B 1/00* (2006.01)

(52) U.S. Cl. ..... 114/355; 114/356; 114/360

(58) Field of Classification Search ..... 114/356, 114/68, 360, 123, 248, 61.1, 61.2, 355; D12/317
See application file for complete search history.

(56) References Cited

U.S. PATENT DOCUMENTS

| | | | | |
|---|---|---|---|---|
| 2,698,447 | A | | 1/1955 | Potts et al. |
| 3,797,435 | A | | 3/1974 | Dunson |
| 3,822,662 | A | | 7/1974 | Morita |
| 4,233,920 | A | | 11/1980 | Wood et al. |
| 4,287,624 | A | | 9/1981 | Lowther |
| 4,520,746 | A | | 6/1985 | Walters et al. |
| 4,694,770 | A | * | 9/1987 | Kitner et al. ..... 114/123 |
| 5,215,031 | A | | 6/1993 | Inman et al. |
| 5,357,888 | A | | 10/1994 | Insinna |
| 5,515,802 | A | | 5/1996 | Bree |
| 5,647,297 | A | | 7/1997 | Hansen |
| 5,870,965 | A | | 2/1999 | Hansen |
| 6,135,834 | A | | 10/2000 | Polakowski |
| 6,371,039 | B1 | | 4/2002 | Hemphill |
| 6,408,782 | B1 | | 6/2002 | Mitchell |
| 6,419,532 | B1 | | 7/2002 | Bradish, Jr. |
| 6,520,107 | B1 | * | 2/2003 | Hickok ..... 114/355 |
| 6,612,256 | B1 | | 9/2003 | Martin |
| 6,871,612 | B2 | | 3/2005 | Gursoy |
| 2004/0261685 | A1 | | 12/2004 | Seidel |
| 2005/0051075 | A1 | | 3/2005 | Buzzi |
| 2006/0191465 | A1 | | 8/2006 | Marcellus |

* cited by examiner

*Primary Examiner* — Ed Swinehart
(74) *Attorney, Agent, or Firm* — Jensen & Puntigam, P.S.

(57) ABSTRACT

A stabilized watercraft having a pointed bow, a transom and curved sides, and a rigid buoyancy tube which extends from the bow to a point past the transom. The tube has a cross-section which is approximately rectangular, but is generally somewhat wider in a lower portion than in an upper portion thereof over at least an aft portion of the boat. The tube has a dead rise in the range of 0° to +15° with the upper surface of the tube being flared outwardly in the range of 30°-80° at the bow portion of the watercraft and an angle of 60°-80° at the stern portion.

8 Claims, 2 Drawing Sheets

RIGID TUBE BUOYANCY ASSEMBLY FOR BOATS

TECHNICAL FIELD

This invention relates generally to stabilizing/buoyancy arrangements for a boat, and more specifically concerns a buoyancy structure which extends from the vicinity of the bow of the boat to the stern, providing enhanced stability for the boat.

BACKGROUND OF THE INVENTION

Various stabilizing arrangements for boats are known. Some stabilizing arrangements utilize foam tubes which extend around a portion of the boat. Examples of such structures are shown in U.S. Pat. No. 4,287,624 to Lowther and U.S. Pat. No. 5,647,297 to Hansen. Other stabilizing arrangements use inflatable tubes. Examples include U.S. Pat. Nos. 5,878,685 and 6,371,039, both to Hemphill, and U.S. Pat. No. 5,228,407 to Cummer et al. Rigid, hard-sided aluminum or fiberglass arrangements are also known, such as shown in U.S. Pat. No. 6,871,612 to Gursoy. Various cross-sectional configurations are known for such stabilizing tubes, including circular, D-shaped and rectangular arrangements.

The above arrangements do have disadvantages. In some arrangements, for instance, the tubes are arranged to provide only enough buoyancy to keep the vessel from sinking. Such arrangements are not considered to be true stabilized watercraft. Further, in many arrangements, performance is sacrificed by the particular design/configuration of the buoyancy structure. Still further, some arrangements provide satisfactory stabilization under certain conditions, but not in other conditions.

It would be desirable to have a stabilizing tube/buoyancy device which provides high static stability, as well as consistent high performance and sea-keeping ability, for various hull shapes, including deep-vee hull configurations. It is also desirable that the buoyancy device achieve a maximum static lateral stability for the boat, even when the boat is lightly loaded. It is further desirable that the buoyancy device be arranged to provide safety, stability and performance under a wide variety of sea conditions, in particular to provide buoyancy sufficient to maintain the vessel in an upright position and also allow the main deck of the cockpit to be self-bailing, such that water will evacuate on its own with no mechanical assistance, even under fully swamped conditions.

DISCLOSURE OF THE INVENTION

Accordingly, a buoyancy device is disclosed herein, as follows: a rigid tube which extends from a bow portion of the boat to a point at or past a transom of the boat, wherein the tube has a cross-section which is generally rectangular over most of the length of the tube, wherein a lower portion of the tube is wider than an upper portion thereof over an aft portion of the tube, and wherein the tube has a dead rise in the range of −45° to +25°.

A stabilized watercraft which includes a buoyancy device is disclosed as follows: a rigid hull having a transom, a pointed bow and a pair of curved sides which extend between the bow and the transom; a rigid buoyancy tube which extends from the bow of the hull to a point at or past the transom of the boat, wherein the tube has a cross-section which is generally rectangular over most of the length of the tube, wherein a lower portion of the tube is wider than an upper portion thereof over an aft portion of the tube, and wherein the tube has a dead rise in the range of −45° to +25°.

BEST MODE FOR CARRYING OUT THE INVENTION

Figure 1:
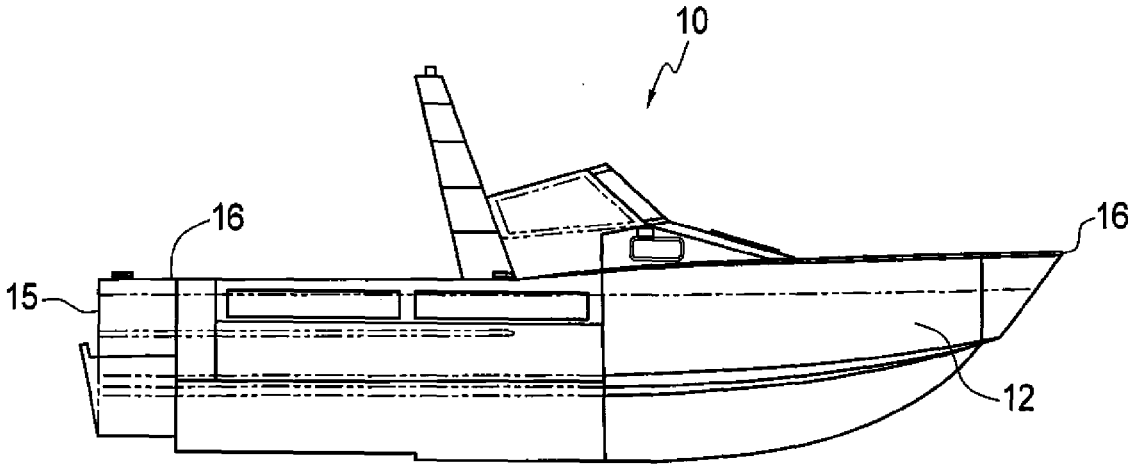
FIG. 1 is an elevational view of the boat with the attached buoyancy device shown and described herein.
Figure 2:
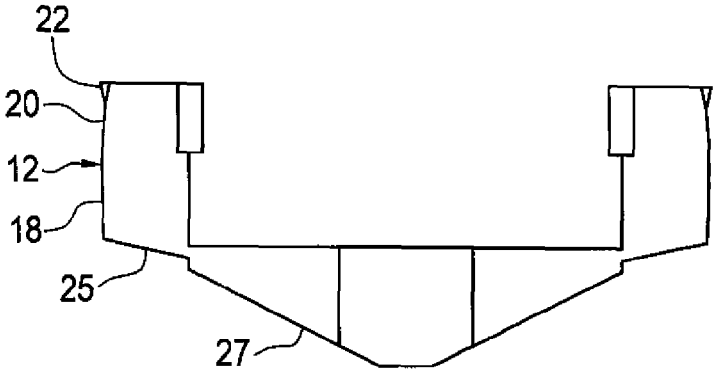
FIG. 2 is a lateral cross-sectional view of the boat and attached buoyancy device of FIG. 1.
Figure 3:
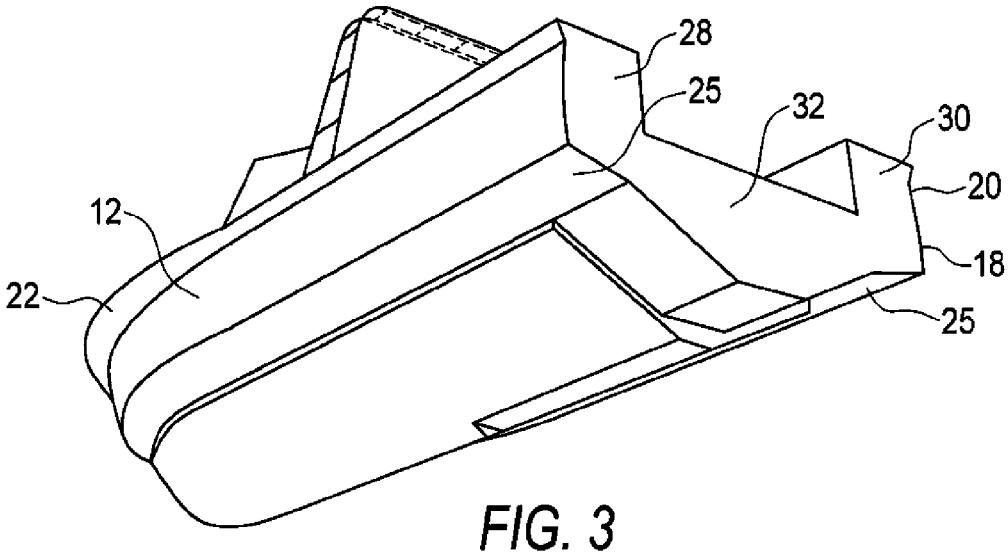
FIG. 3 is a perspective view, from below, of the boat and buoyancy device of FIG. 1
Figure 4:
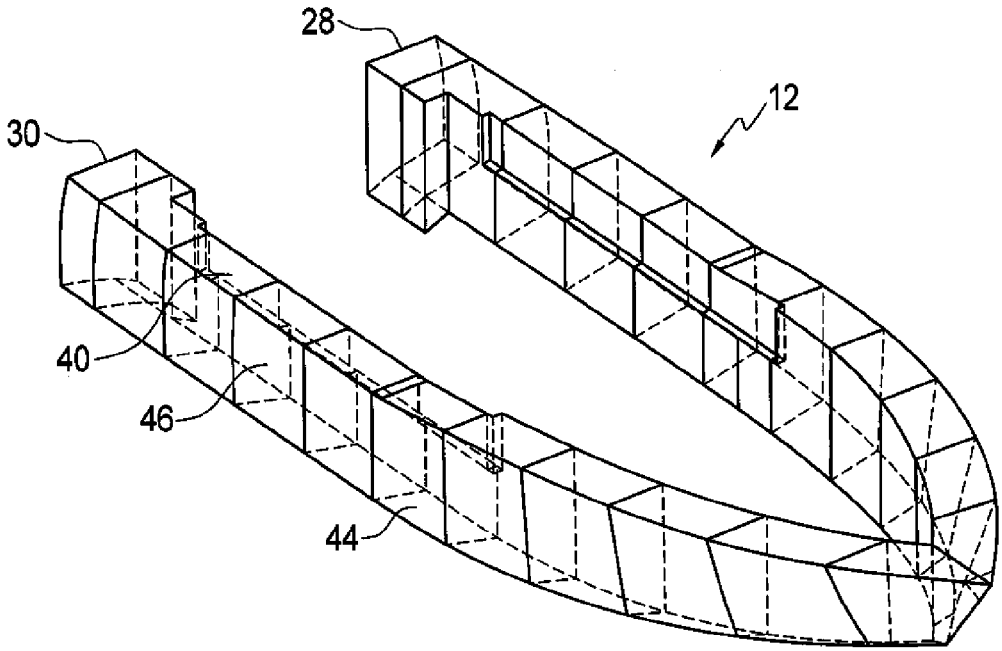
FIG. 4 is a perspective view of the buoyancy device itself.

FIGS. 1-4 show a boat 10 with a stabilizer/buoyancy tube generally at 12. The stabilizer tube 12, also referred to herein as a buoyancy tube, extends from a point forward of the stem of the hull, defining a pointed bow 16, to the stern 15 of the boat, in particular a selected distance beyond the end of transom 16. The buoyancy tube 12 in the embodiment shown is rigid, made from aluminum. It could also be made from other rigid metal or plastic material such as fiberglass. The buoyancy tube in the embodiment shown is approximately rectangular, approximately 27 inches high, although this could vary. While approximately rectangular, the buoyancy tube does have a unique cross-sectional configuration, which changes along its length as described in detail below.

The bottom portion 18 of the buoyancy tube 12 is wider than the upper portion 20 over a substantial portion of the length of tube 12. In one embodiment, the bottom portion 18 is approximately 14 inches wide. At approximately mid-height of tube 12, the width begins to decrease in a slight inward curve. At the upper end of tube 12 is an outwardly flared portion 22. The flared portion is approximately 4 inches high at the stern end of the tube, increasing to 12 inches or in some cases more at the bow, in the embodiment shown. The angle of the flare is within the range of 30°-80° (from the horizontal), with a preferred range of approximately 45°-75° toward the bow. A most preferred range toward the bow is 45°-50°. The flare does change from the stern to the bow of the boat. In the vicinity of the stern, the angle is 60°-80° (from the horizontal), preferably 70°-75°.

The overall dimensions of the buoyancy tube can vary to some extent to enhance the performance, safety and stability of the hull under different sea conditions, and also to ensure rigidity and impact mitigation. The tube in the embodiment shown, for instance, extends approximately 22 inches beyond the hull transom 16, which aids in the overall stability of the boat, increasing the buoyancy of the tube aft of the transom by as much as 50%. In some cases, the free rear ends 28 and 30 (FIG. 4) of the buoyancy tube are connected by an additional buoyancy piece 32, which further increases the overall buoyancy effect of the tube and the boat.

In the embodiment shown, the buoyancy tube has a dead rise 25 within the range of −45° to +25°, preferably in the range of 0° to +15° and most preferably approximately +12°. The hull of a deep-vee boat, shown in FIG. 2, could have a dead rise 27 within the range of 15°-30°. In one specific example, the dead rise of the hull is 25°. The dead rise of the boat hull can vary significantly. The buoyancy tube is mounted so that the bottom edge of the tube is at the chine of the hull or within 4 inches above the chine. The preferred distance is 2 inches. The buoyancy tube is attached permanently to the boat by welding or the like, or alternatively, attached to a connecting member which in turn is secured permanently to the boat, and hence does not require a separate top and/or bottom mounting flange, which is usually required for an inflatable or foam tube.

In the embodiment shown, the cross-section of the tube will vary from the stern to the bow of the boat. Toward the rear of the boat, the lower portion of the tube will be larger than the upper portion thereof, as described above. However, as the tube extends toward the bow, the width of the lower portion thereof will decrease, such that toward the bow, the cross-section of the buoyancy tube becomes almost triangular, with a flat top surface 40, an inwardly angled outer surface 46 and a narrow lower surface 44 which decreases in width in the direction of the bow. This is shown most clearly in FIG. 4, which for clarity does not show the flair at the upper edge. The buoyancy tube is wider in the bottom portion aft of approximately amidship and wider at the top than the bottom forward of amidship; the outside of the buoyancy tube thus has a somewhat warped or twisted shape as it extends from the stern to the bow.

The rigid buoyancy tube described herein has a number of advantages. The particular configuration provides increased stability and buoyancy for a boat, particularly in the aft region, toward the stern of the boat. Improved lateral stability in both the static condition and at operating speed is due to the shape of the tube, in particular, the tube being wider at the bottom than at the top in the aft (stern) portion of the tube. This provides desired improved stability towards the stern of the boat. Forward of approximately amidship the tube diminishes in size, both in height and width of the lower portion thereof, and changes configuration, because less buoyancy is needed in that region. The tube terminates at a pointed bow, rather than a square or blunt bow as is the case of typical inflatable or foam tubes.

The overall shape of the tube increases the initial stability over other buoyancy arrangements and provides a maximum buoyancy at least as great as existing D-shaped foam tubes, while requiring less cross-sectional room, which is an important advantage. The flared portion at the top of the tube is also advantageous, in that it deflects spray during operation outwardly from the boat. The extension of the buoyancy tube beyond the stem of the hull, ending in a pointed bow, provides optimal capability in certain sea conditions. The position of the lower edge of the buoyancy tube, at or above, preferably 2 inches above, the chine of the hull, in combination with the dead rise angle of the buoyancy tube, reduce the wetted surface and drag for optimal performance and seakeeping characteristics.

Although a preferred embodiment of the invention has been disclosed for purposes of illustration, it should be understood that various changes, modifications and substitutions may be incorporated in the embodiment without departing from the spirit of the invention which is defined by the claims which follow.

What is claimed is:

1. A stabilized watercraft, comprising:

a rigid hull having a transom, a pointed bow and a pair of curved sides which extend between the bow and the transom; and a rigid buoyancy tube permanently attached to the rigid hull, wherein the tube extends from the bow of the hull to a point at or past the transom of the boat, wherein the tube has a cross-section which is generally rectangular over most of the length of the tube, wherein the tube has a vertical dimension which is greater than a width dimension, and wherein the tube has an outer surface which includes a generally vertical portion which extends along at least a portion of the length of the tube and a lower surface which is generally flat and extends from a chine of the hull to said generally vertical portion, wherein a lower portion of the tube is wider than an upper portion thereof throughout an aft portion of the tube, and wherein the tube has a dead rise in the range of −45° to +25.

2. The buoyancy tube of claim 1, wherein the dead rise is in the range of 0° to +25°.

3. The watercraft of claim 1, wherein the tube at an uppermost surface thereof flares outwardly at an angle within the range of 30°-80° at the bow.

4. The watercraft of claim 3, wherein the angle of the flare is within the range of 60° to 80° at the stern.

5. The watercraft of claim 2, wherein the tube is mounted such that a lower edge thereof is mounted at or within 4 inches above the chine of the hull.

6. The watercraft of claim 1, wherein the tube is made from aluminum.

7. The watercraft of claim 1, wherein the cross-section of the tube becomes increasingly narrower at a lower surface relative to an upper surface thereof, toward the bow of the boat, providing a twisted configuration to the tube.

8. The watercraft of claim 1, wherein the buoyancy tube extends beyond the stem of the hull, forming a pointed bow.

* * * * *